US010183514B2

(12) United States Patent
Kotik et al.

(10) Patent No.: US 10,183,514 B2
(45) Date of Patent: Jan. 22, 2019

(54) CURING CALIBRATIONS

(71) Applicant: Hewlett-Packard Industrial Printing Ltd., Netanya (IL)

(72) Inventors: Eyal Kotik, Netanya (IL); Alon Levin, Netanya (IL)

(73) Assignee: HP SCITEX LTD., Netanya (IL)

( * ) Notice: Subject to any disclaimer, the term of this patent is extended or adjusted under 35 U.S.C. 154(b) by 0 days.

(21) Appl. No.: 15/468,298

(22) Filed: Mar. 24, 2017

(65) Prior Publication Data

US 2017/0313110 A1 Nov. 2, 2017

(30) Foreign Application Priority Data

May 2, 2016 (EP) ..... 16167928

(51) Int. Cl.
*B41J 29/38* (2006.01)
*B41J 2/01* (2006.01)
*B41J 11/00* (2006.01)

(52) U.S. Cl.
CPC ..... *B41J 29/38* (2013.01); *B41J 11/002* (2013.01)

(58) Field of Classification Search
CPC ..... B41J 11/002; B41J 29/377; B41J 15/16; B41J 15/165
USPC ..... 347/16, 101, 102
See application file for complete search history.

(56) References Cited

U.S. PATENT DOCUMENTS

| | | | |
|---|---|---|---|
| 5,220,348 | A | 6/1993 | D'Aurelio |
| 7,835,057 | B2 | 11/2010 | Kayser et al. |
| 2007/0258102 | A1 | 11/2007 | Beielak et al. |
| 2010/0154244 | A1 | 6/2010 | Kuta et al. |
| 2010/0247795 | A1 | 9/2010 | Heath |
| 2014/0002558 | A1 | 1/2014 | Ramesh et al. |
| 2014/0354743 | A1 | 12/2014 | Tsuchiya |

OTHER PUBLICATIONS

Choi, Hwan Eon, et al. "Color printer calibration technique based on human visual perception." In Knowledge-Based Intelligent Information Engineering Systems, 1999. Third International Conference, pp. 107-111. IEEE, 1999.

*Primary Examiner* — An Do
(74) *Attorney, Agent, or Firm* — HP Inc. Patent Department

(57) ABSTRACT

Examples described herein include method for calibrating LED modules in a curing engine. The method of calibrating UV curing modules includes receiving an uncured calibration image and initiating a curing operation that includes operating the curing modules according to a plurality of corresponding initial power level settings to apply radiant energy to the uncured calibration image to generate a cured calibration image. The method further includes receiving user input or information about an image characteristic of the cured calibration image from a user. The method then includes analyzing the user input to generate adjustments to the corresponding initial power level settings, and then applying the adjustments to the corresponding initial power level settings to generate a plurality of corresponding adjusted power level settings.

14 Claims, 6 Drawing Sheets

CURING CALIBRATIONS

BACKGROUND

Printing devices include systems for handling print media, applying printing material to the print media, and, in some devices, systems for curing the printing material once it is applied to the print media. In devices that include a curing system, curing of the printing material may take the form of air curing, heat curing, or curing by exposure to radiant energy, such as infrared (IR) and ultraviolet (UV) radiation. To help produce consistent and durable printed images, the curing system can be calibrated using various calibration devices, processes, and routines.

DETAILED DESCRIPTION

Figure 1:
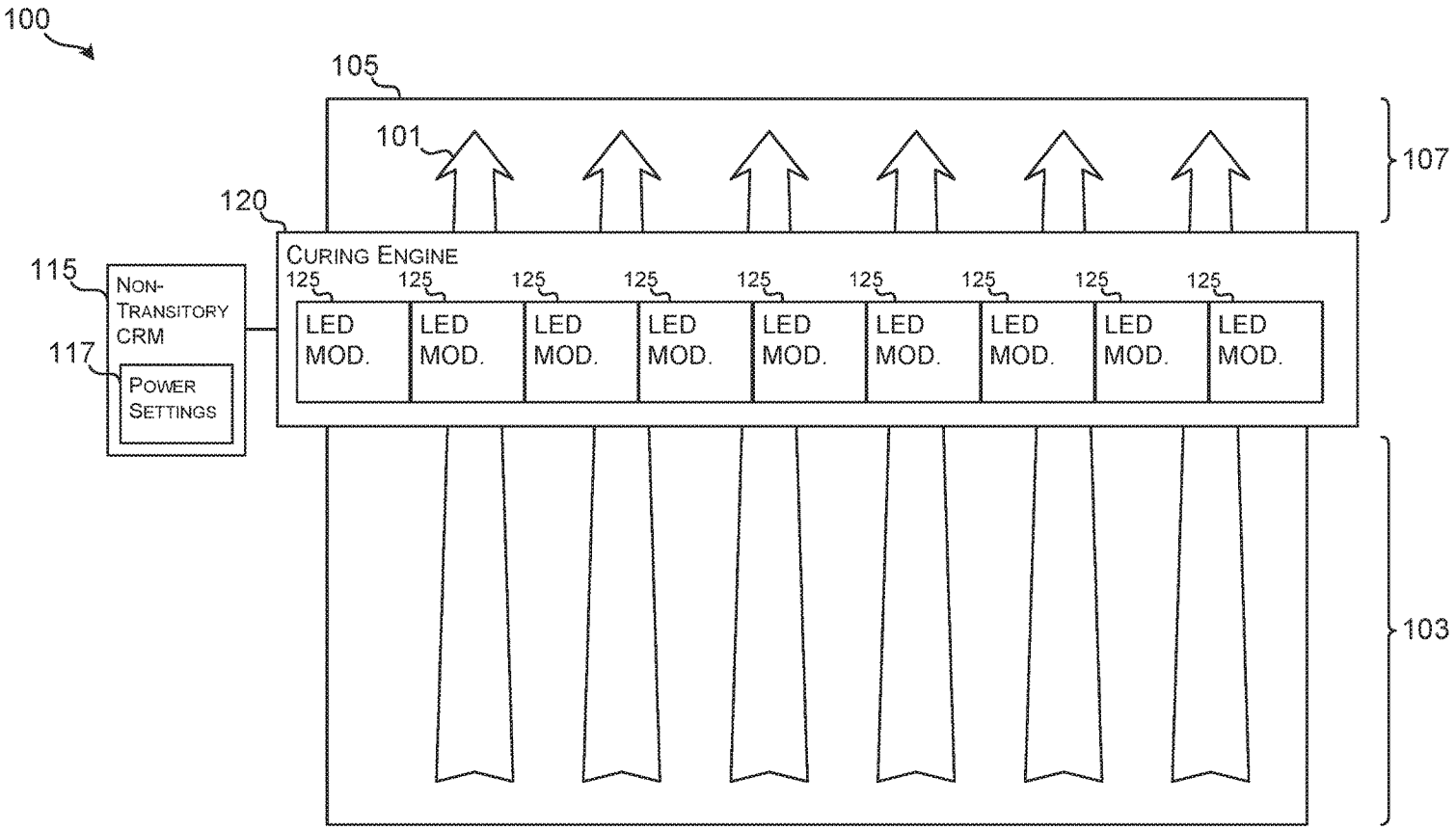
FIG. 1 depicts a schematic representation of an example curing system with variable curing modules.

In various printing and curing systems, once printing materials, such as inks, pigments, or dyes, are applied to a print media, additional steps can be used to fix or make the printed image permanent on the print media or develop the desired finish, texture, or color. For example, some printers include use radiant energy, such as infrared (IR) and ultraviolet (UV) light, to cure the correspondingly sensitive printing materials.

In example implementations described herein, radiant energy used to cure the printing material can be supplied by curing modules that include various types of the radiant energy sources. The radiant energy sources can be in the form of lamps or light emitting diodes (LEDs). As such, each curing module can include any number of radiant energy sources arranged in various arrays and configurations to provide a desired radiant output. For example, UV LEDs can be positioned on a circuit board in grid pattern in a curing module to provide an even radiation pattern over some predetermined area when driven with a particular power level setting (e.g., a predetermine drive current or voltage).

To expand the area, additional curing modules can be added. However, due to normal variations in the various manufacturing processes or age of the curing modules and/or radiant energy sources, the radiant energy output can vary from curing module to curing module, even when driven with a common power level setting. To correct for variations in the radiant energy output, each curing module can be calibrated to generate a radiant energy output that is consistent or even with its neighbors. Calibration of the curing modules, in various examples implementations, can include identifying a power level setting for each curing module so that each curing module generates a radiant energy output within some predetermined range of output levels.

Since various visual image characteristics, such as sheen, color density, hue, and the like, of a cured printed image can vary based on the radiant output energy, the differences in a calibration image can be visual detected and used as input data. For example, a user can visually inspect a cured calibration image and, using a corresponding user interface, input indications of where and how specific image characteristics vary across the printed image. Various implementations can use such user input to make adjustments to the power level settings with which each of curing module in an array of modules to generate an even or consistent radiant energy.

In some implementations, multiple calibration images can be printed, cured, and inspected to iteratively arrive at a desired level of consistency in image characteristics across a printed image. In other example implementations, each curing modules can be driven with varying power level setting across an image to generate correspondingly varied image characteristics in a single cured calibration image. In such implementations, a desired level of image characteristic consistency can be achieved by inspecting a single cured calibration image, thus avoiding multiple calibration images and saving time and printing material. Such implementations and systems are describe in more detail below in reference to specific examples depicted in the accompanying drawings. These examples are meant to be illustrative only, and are not intended to limit the scope of the specification or the accompanying claims.

FIG. 1 depicts an example curing system 100 according to various implementations of the present disclosure. As illustrated, the curing system 100 can include a curing engine 120 that is coupled to or includes a non-transitory computer readable medium 115, such as a hard drive, flash memory, RAM, solid-state drive (SSD), and the like. The non-transitory computer readable medium 115 can include various information for operating the curing engine 120.

In one example implementation, the non-transitory computer readable medium 115 can include data corresponding to power settings 117 that the curing engine 120, or a remotely controlled or separately situated controller or processor, can use to operate multiple curing modules. In the particular example shown, the curing engine 120 can include multiple LED based curing modules 125. For the sake of brevity and clarity, the term "LED module" is used herein to refer to any energy source with which the curing engine 120 can be outfitted to cure a printed image. For example, the LED module 125 can include an array of multiple LEDs. The array of LEDs can include any number or combination of LEDs. For example, in one implementation, the LEDs of any particular LED module 125 can be of a particular type of LED having a corresponding spectral output that is either dependent or independent of various operational settings. In other implementations, the LEDs of any particular LED module 125 can be a mixture of different types of LEDs. The different types of LEDs can have correspondingly different spectral or power outputs that are either dependent or independent of various operational settings.

In example implementations in which the LEDs of a particular LED module 125 are nominally within a range of acceptable performance characteristics, the spectral content, intensity, and power output of an array of LEDs can be variable according to, and thus can be controlled by, the control signals use to drive eight particular LED modular 125. While a particular control signal used to drive a particular LED module 125 can be defined by various electrical properties, such as current, voltage, frequency, and the like, implementations of the present disclosure use the term "power level settings" as a generic term to describe a set of electrical characteristics that define a particular control signal used to drive an LED module 125.

In implementations in which the LED modules 125 of the curing engine 120 are individually controllable, the curing engine can use specific power level settings to drive specific LED modules 125. The curing engine 120 can retrieve power level settings 117 from the non-transitory computer readable medium 115. Once the power level settings 117 are retrieved, the curing engine 120 can use the power level settings to drive the LED modules 125 to cure an image printed on the print media 105. In the example shown, the substrate 105 can move in a direction indicated by arrow 101 relative to the curing engine 120. For example, the substrate 105 can be moved along a particular print path or curing path of a printing or curing device by corresponding belts, platforms, carriers, etc., under the curing engine 120. In such implementations, the radiant energy, such as infrared light or ultraviolet light, can be directed from the curing engine 120 to the printed surface of the substrate 120. In the example shown, the region 103 of the substrate 105 is the uncured portion of the printed image before is exposed to the radiant energy from the curing engine 120, and the region 107 is the cured portion of the printed image during or after exposure to the radiant energy from the curing engine 120.

Due to the variations between the performance characteristics of the individual LED modules 125, the curing of the printed image on the substrate 105 can include inconsistencies and variations in image characteristics. For example, some printing materials (e.g., inks, latex films, toners, etc.) can have different color saturations, densities, glossiness, stiffness, resiliency, etc., based on the duration, intensity, and spectral outputs of the radiant energy used to cure the printed image. As such, variations in performance characteristic of the individual LED modules can cause variation in the image characteristics of the printed image in a direction transverse to the path direction 101.

To compensate for variations in the performance characteristics of the individual LED modules 125 due to factors such as, manufacturing variations, quality control variations, age, usage, and the like, implementations the present disclosure include systems and methods in and for the curing engine 120 to calibrate the LED modules 125 based on user input corresponding to a visual inspection of the image characteristics of a cured calibration image. Based on user input, example implementations of the present disclosure can generate adjustments to the power level settings 117 with which each individual LED module 125 is driven. Goals of the adjustments can include attempts to generate radiant energy from each of the LED modules 125 within a desired range of performance or characteristics. For example, adjustments to the power level settings 117 can be generated based on analysis of user input such that when each of the LED modules 125 are driven with corresponding adjusted power level settings 117, each of the LED modules 125 emits radiant energy with a similar spectral profile and intensity.

Figure 2:
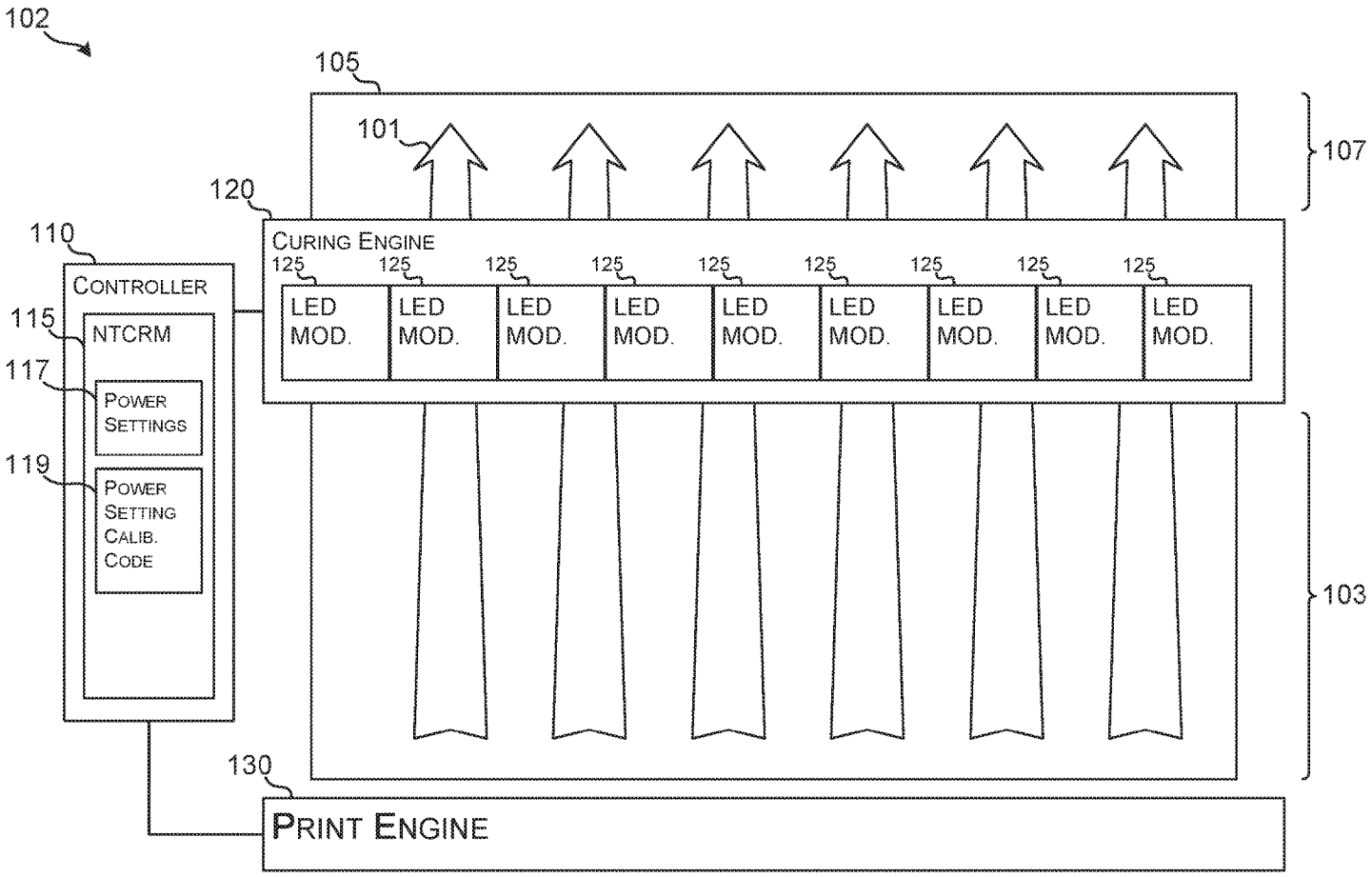
FIG. 2 depicts a schematic representation of an example printing system with variable curing modules.

FIG. 2 depicts an example printing system 102 that includes systems, devices, and/or computer executable code for calibrating LED modules 125 in a curing engine 120, according to various implementations of the present disclosure. As shown, the printing system 102 can include a curing engine 120 similar to that described in reference to FIG. 1. The printing system 102 can also include a print engine 130 for receiving print data and generating a printed uncured image on a substrate 105. In some implementations, the printing system 102 can also include a controller 110 coupled to the curing engine 120 and/or the print engine 130. The controller 110 can include various types of computing devices, processors, controllers, or any combination of hardware or computer executable instructions for implementing the various functionality of the curing system 100 or the printing system 102 described herein. The print engine 130 can include various types of printing mechanisms. For example, the print engine 130 can include inkjet print heads that selectively eject drops or streams of curable print material on to the substrate 105 to generate an uncured printed image.

In some implementations, the controller 110 can include a processor (not shown) that can access the non-transitory computer readable storage medium 115 to access information stored thereon that represents the power level settings 117 and/or the power setting calibration code 119. The controller can access the power level settings 117 and either send them to the curing engine 120 or use them to control the curing engine 120 to drive the individual LED modules 125.

As described herein, the power level settings 117 can include information that can correlate input control signals provided to the LED modules 125 with an expected radiant output. For example, the power settings 117 can include power level settings with which the LED modules 125 are expected to generate a relatively uniform radiant energy distribution across a substrate 105 to uniformly cure a printed image. Due to the variations between the LED modules 125, at any given time the actual radiant energy output levels emitted by the individual LED modules 125 generated by particular sets of power level settings can drift or vary from the expected radiant output levels. As described herein the variations of the radiant energy outputs between the LED modules 125 can cause undesirable inconsistencies in the curing of the printed image and the resulting image quality or characteristics. As such, the operator of a printing system 102, or curing system 100, can systematically, periodically, or on demand, choose to calibrate the curing engine 120 so that the LED modules 125 cure a printed image to have the desired image characteristics or consistency thereof.

In one implementation, the controller 110 can execute the power setting calibration code 119 to control the print engine 130 to generate a calibration image on the substrate 105. The calibration engine can include any type of calibration or test image generated based on image data included in the power setting calibration code 119 or provided by another component of the controller 110 or a remote system (e.g., a desktop computer, laptop computer, tablet computer, smart phone, etc.). In some implementations, the calibration image can include various fields of solid color that run across the width of the substrate 105. In other implementations, the calibration image can include a single field of a particular pattern, color, or imaged texture, across which variations in the curing of the printed image would be evident upon a visual inspection by a user.

In the configuration shown in FIG. 2, the print engine 130 is upstream in a particular print path indicated by the directional arrow 101. As such, the curing engine 120 can be referred to as being in a downstream position relative to the print engine 130 in the print path indicated by arrow 101. In such configurations, the curing engine can expose the uncured regions 103 of the printed image on the substrate 105 to radiant energy to generate a cured image region 107. Once the entire length of the substrate 105 passes by the curing engine 120, the entire image is expected to be within the cured region 107.

Figure 3:
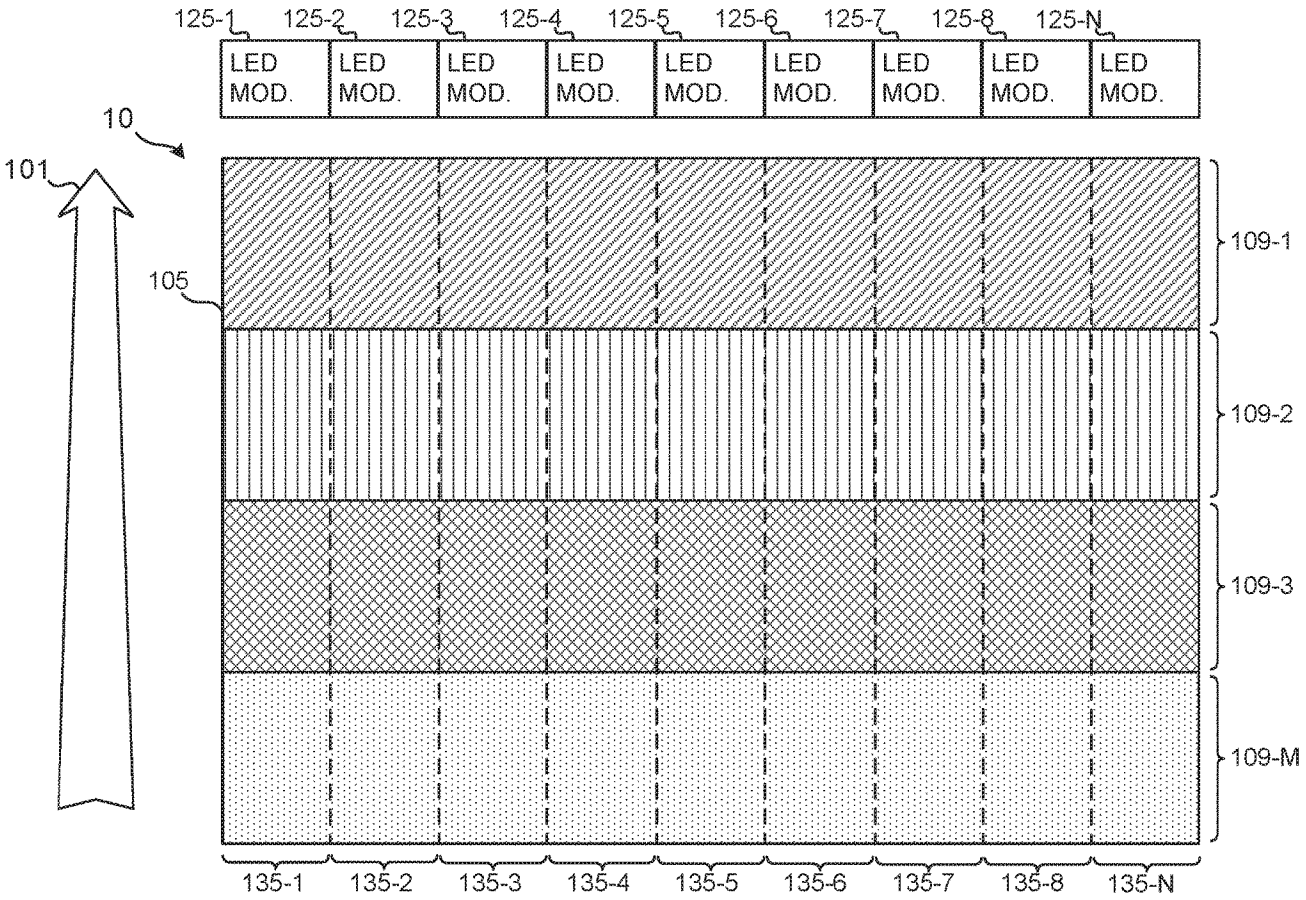
FIG. 3 depicts an example of an uncured calibration image.

FIG. 3 depicts an example uncured calibration image 10, according to various implementations the present disclosure.

The uncured calibration image 10 can be provided by a corresponding print engine, such as print engine 130 depicted in FIG. 2. In the particular example shown, the uncured calibration image 130 includes multiple regions 109 the span the width of the substrate 105. The regions 109 can include various bands of a particular image type. The image type can include solid fields of a particular color, pattern, texture, coating, etc. In various example implementations, it is useful to have a consistent or repeated uncured calibration images printed across the width of the substrate 105 before it is exposed to the radiant energy of the LED modules 125 to facilitate the detection of variations in the cured calibration image caused by variations in performance of the LED modules 125. While the example uncured calibration image 130 depicts M, where M is an integer, regions 109 in the form of color or pattern bands that span the width of the substrate 105, other calibration patterns can also be used. For example, the uncured calibration image 10 can include a single edge-to-edge field of a single color, pattern, image, texture, or coating.

Each of the N curing zones 135, where N is an integer, correspond to the N LED modules 125. While the dashed lines separating the curing zones 135 are illustrated in FIG. 3, such markings can be omitted from an actual uncured calibration image 10. Once the uncured calibration image 10 is generated, it can move in the direction indicated by arrow 101 of the processing path of the curing engine 120 that includes the LED modules 125.

Figure 4:
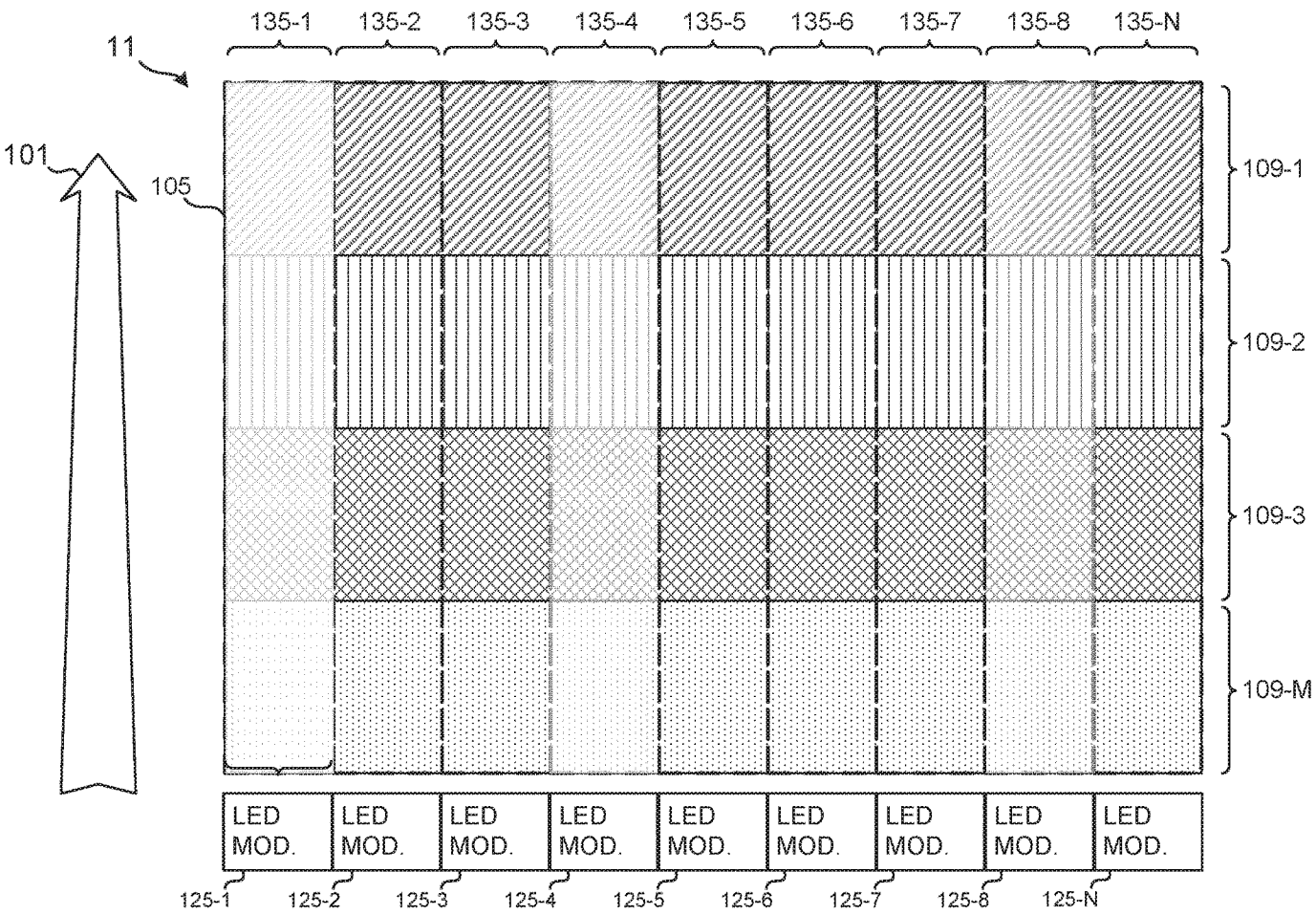
FIG. 4 depicts an example of a cured calibration image.

FIG. 4 depicts an example cured calibration image 11 after having traversed the processing path indicated by arrow 101 pass the LED modules 125 of the curing engine 120. As depicted, each one of the curing zones 135 or cured by a particular LED module 125 operated or driven by a particular set of power level settings 117. In some scenarios, the power level settings 117 can include an initial or defaults set of power level settings stored and a non-transitory computer readable medium 115 associated with the curing engine 120 and/or each of the LED modules 125. In some example implementations, the initial power level settings represent the power level settings determined during or by a previous calibration session or routine.

The variations in the example cured calibration image 11 indicate variations in various image characteristics that can be visibly detectable by a user. For example, the variations across all regions 109 in the curing zone 135-1 can represent variations in image characteristics, such as sheen, smoothness, saturation, glossiness, color density, and the like, that are dependent on the radiant energy output emitted by the corresponding LED module 125-1. Similarly, the variations in the image characteristics depicted in curing zones 135-4 and 135-8 of the example cured calibration image 11 can represent corresponding variations in the performance characteristics of LED modules 125-4 and 125-8. The example scenario depicted by example cured calibration image 11, LED modules 125-1, 125-4, and 125-8 can be adjusted by altering the corresponding power level settings. The degree to which the corresponding power level settings are to be adjusted can be determined based on analysis of user input regarding the visual inspection of the variations in the image characteristics of the cured calibration image.

In various implementations of the present disclosure, the curing system 100 or printing system 102 can include a user interface through which the system can receive user input indicating the nature and/or descriptions of the image characteristic variations in the cured calibration image. In one example implementation, the user interface can include a visual representation of the cured calibration image and tools with which a user can indicate which curing zones 135 include a variation in a particular image characteristic. Such tools can include a graphical user interface (GUI) through which a user can enter indications of the type of variation in the visual characteristics of the cured calibration image 11. For example, the GUI can include a visual representation of the curing zones 135 and various tools or menus a user can use to indicate a particular image characteristic variation in a particular curing zone 135. User input corresponding to the variations in image characteristics of the example cured calibration image 11 can include indications that curing zones 135-1 135-4 and 135-8 include surface finish that has less sheen than the desired glossy finish in the curing zones 135-2, 135-3, 135-5, 135-6, 135-7, and 135-N. Such user input can then be used by other aspects of the present disclosure to determine which adjustments to which power level settings corresponding to specific LED modules 125 to make.

While print or curing paths of various examples described herein are illustrated as traversing a single direction 101, various example implementations can also include passing substrate 105 with a printed image on it past the curing engine 120 in multiple directions. For example, the substrate can be moved back and forth under the curing engine 120 to expose the image printed thereon to the radiant energy from the LED curing modules 125 multiple times.

In addition, various example printing systems, similar to printing system 102 can include multiple curing engines 120. In one example, printing system can include an additional curing engine 120 disposed on the same side of the substrate 105 but on the other side of the print engine 130 (e.g. in an upstream position). In other examples, an additional curing engine 120 can be disposed on the opposite side of the substrate 105 (e.g., on the underside) to facilitated curing two-sided printed images. In any such implementations, the LED modules 125 can be calibrated using the various calibration images, systems, and methods described herein.

Figure 5:
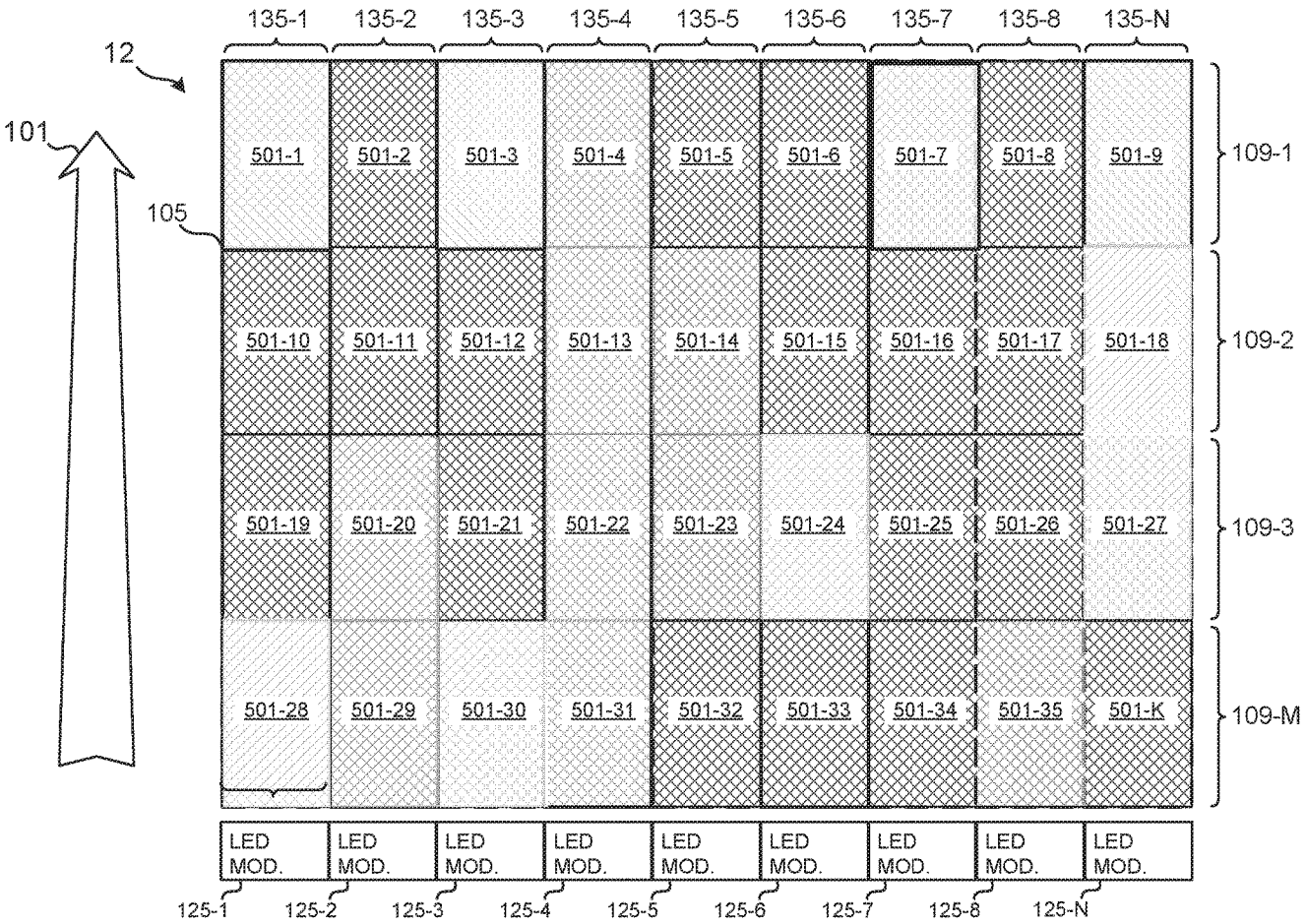
FIG. 5 depicts another example of a cured calibration image.

FIG. 5 depicts an example cured calibration image 12 according to various other implementations of the present disclosure. To generate the example cured calibration image 12, a corresponding print engine 130 can print an uncured calibration image that includes a consistent field of color, patterns, images, or the like. The uncured calibration image can then be exposed to variable radiant energy emitted by the LED modules 125 driven by corresponding variable power level settings. For example, as the substrate 105 on which the uncured calibration image 12 is printed passes by the array of LED modules 125, each of the LED modules 125 can be driven with different power level settings. Accordingly, as depicted in FIG. 5, as the regions 109 pass under the LED modules 125, each of the curing zones 135 can be segmented into additional sub zones 501 that correspond to the corresponding LED module 125 being driven with a particular power level setting. For example, LED module 125-1 can be operated with up to M different power level settings to cure the various regions 109 to generate the individual curing zones 501-1, 501-10, 501-19, and 501-28.

The power settings used to drive corresponding LED modules 125 to generate the individual curing zones 501 can vary in steps or continuously. In some implementations, the power level settings can vary in a region set around an initial power level setting for the corresponding LED module 125. To aid the user in determining the power level settings used to generate each of the curing zones 501, the uncured calibration image can be generated to include markings that indicate the power level settings that are to be used by each LED module 125 to cure a particular curing zone 501. For example, each one of the curing zones can be printed to include gridlines, alphanumeric text, or other symbols that correspond to a particular power level setting an/or LED module 125. In this way, a user can easily select the power level settings for each LED module 125 that the user judges will generate the most consistent image characteristics in a cured printed image. The selection of power level settings can then be entered into the curing system 100 and/or the printing system 102 as user input and can be used to make adjustments to the default and/or initial power level settings for the LED modules 125.

Figure 6:
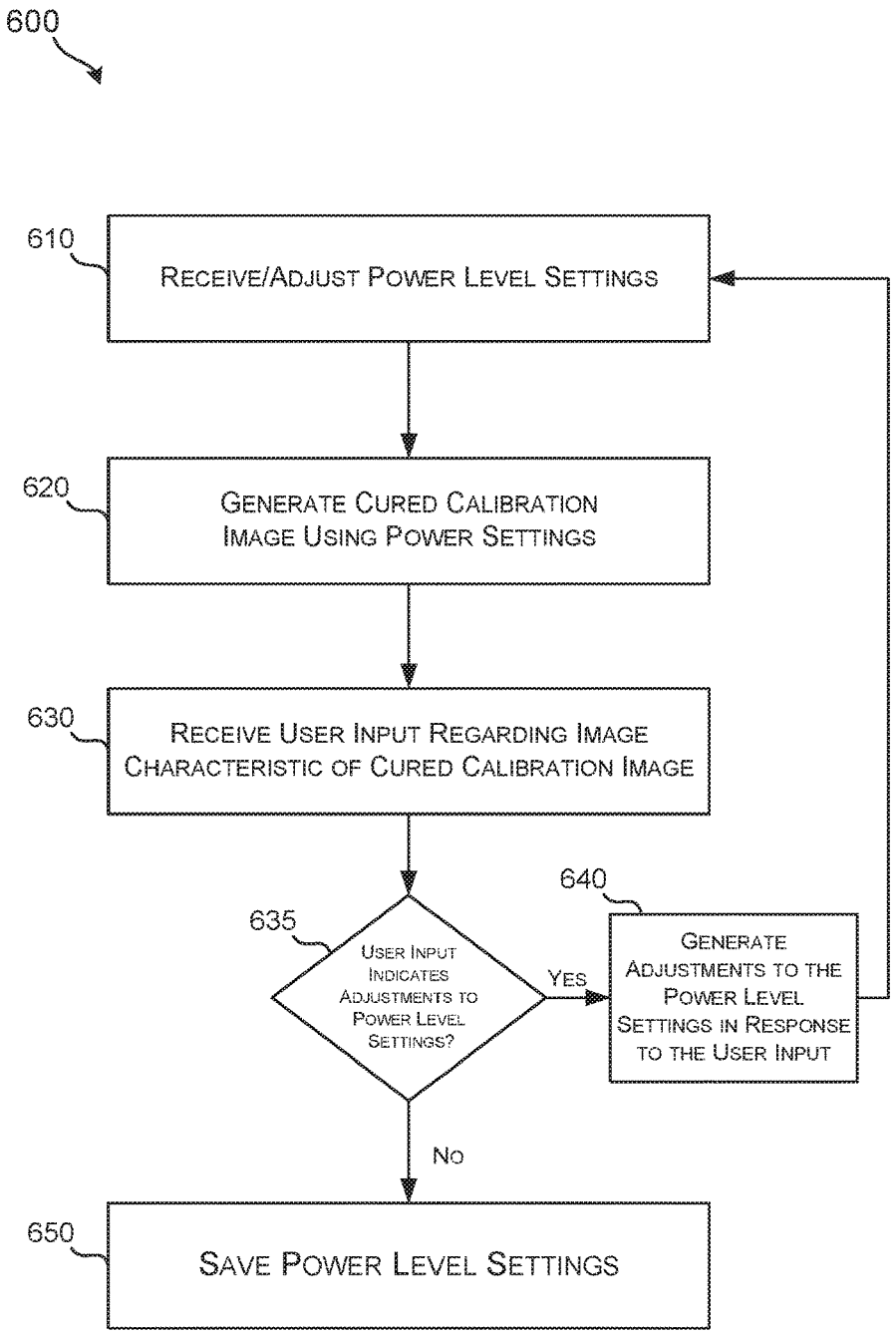
FIG. 6 is a flowchart of an example method for calibrating variable curing modules.

FIG. 6 is a flowchart of an example method 600 for calibrating an array of LED modules 125 in a curing engine 120. Method 600 can begin at box 610 in which the curing system 100 or printing system 102 can receive power level settings for the LED modules 125 and/or a particular curing engine 120 to be used to cure and uncured calibration image 10. Receiving the power level settings can include retrieving previously stored or default power level settings associated with a particular curing engine 120 and/or LED modules 125. For example, the power level settings for particular curing engine 120 can include power level settings for the component LED modules 125 in the particular configuration (e.g., order) in which they are arranged in the curing engine 120. Such power level settings can be stored in a non-transitory computer readable medium 115 included in the curing engine 120 or in an attached memory or computing device. In other implementations, each one of the LED modules 125 includes a non-transitory computer readable medium to store the corresponding power level settings for that particular module. As such, when a curing engine 125 is calibrated according to various implementations of the present disclosure, the power level settings determined for each one of the LED modules 125 can be stored in the modules themselves. As such, as any of the LED modules 125 are moved or rearranged within the curing engine 120 or removed or replaced with a new module 125, the power level settings for a particular LED module 125 can be applied to the correct location in the curing engine 120.

At box 620, the curing system 100 or the printing system 102 can generate a cured calibration image using the power settings. As described herein, generating a cured calibration image can include first controlling a print engine to generate an uncured calibration image. The uncured calibration image can and then be cured using the radiant energy emitted by the curing engine 120 while driving the individual LED modules 125 with the corresponding power level settings. Once the cured calibration image is generated, a user can perform a visual inspection to determine variations in the image characteristics. The curing system 100 or the printing system 102 can then receive user input corresponding to the variations in the image characteristics of the cured calibration image, at box 630. As described herein, the user input can include information regarding the type and degree of image characteristic variation in the particular curing zones 135 and/or 501.

At determination 635, the curing system 100 or printing system 102 can determine whether the user input indicates that adjustments to the power settings are needed. If the user input indicates that the variation in image characteristics across the cured calibration image are within acceptable parameters or expectations of the user, then the method 600 can end at box 650.

However, if at determination 635, the system determines that the user input indicates that adjustments are to be made to the power level settings for some or all of the LED modules 125, then at box 640, the system can generate adjustments to the power level settings for specific LED modules 125 in response to the user input.

In some implementations, performance characteristics of the LED modules 125, expected effects of variations in the radiant energy emitted by the LED modules 125, characteristics of the printing material (e.g., curable ink) and/or the characteristics of the substrate 105 can also be taken into consideration. For example, if a particular curable ink printed on a particular substrate is known or expected to become more glossy under higher intensities of radiant energy, then to adjust the curing zones 135 or 501 to be more glossy or more matte, the power level settings for the corresponding LED module 125 can be correspondingly adjusted (e.g., the power level settings can be increased to generate a more glossy finish or the power level settings can be decreased to generate a more matte finish). The adjustments to the power level settings for various LED modules 125 can then be used to begin the process again at box 610. Boxes 610 through 635 can be repeated until the system determines that the user input does not indicate any adjustments are necessary to the power level settings and the adjusted power level settings are saved at box 650. As described herein, the adjusted power level settings can be saved in a non-transitory computer readable medium 115 included in any components of the curing system 100 or printing system 102.

These and other variations, modifications, additions, and improvements may fall within the scope of the appended claims(s). As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise. All of the features disclosed in this specification (including any accompanying claims, abstract and drawings), and/or all of the elements of any method or process so disclosed, may be combined in any combination, except combinations where at least some of such features and/or elements are mutually exclusive.

What is claimed is:

1. A printing system comprising:

a print engine disposed at a first location in a print path of the printing system;

a curing engine disposed at a second location in the print path;

a controller coupled to the print engine and the curing engine; and a non-transitory computer readable storage medium comprising executable code, that when executed by the controller, causes the controller to control the print engine to:

control the print engine to generate a calibration image;

control the curing engine to cure the calibration image based on curing engine calibration settings to generate a cured calibration image;

receive user input corresponding to a visual inspection of an image characteristic of the cured calibration image; and update the curing engine calibration settings in response to the user input, wherein the curing engine comprises a plurality of curing energy source modules and the curing engine calibration settings comprise individual power level settings corresponding to each of the plurality of curing energy source modules to generate an even radiant energy across a substrate to uniformly cure an image printed on the substrate.

2. The printing system of claim 1 wherein the curing engine comprises a plurality of UV LEDs controllable in groups according to the curing engine calibration settings.

3. The printing system of claim 1 wherein updating the curing engine calibration settings comprises comparing the user input to data corresponding to a desired image characteristic.

4. The printing system of claim 1 wherein the calibration image comprises a plurality of curing zones, each curing zone including markings that indicate a corresponding power level setting used by the curing engine to cure that particular curing zone.

5. The printing system of claim 4 wherein the plurality of curing zones correspond to a particular curing energy module in the curing engine or to steps up or down from an initial power level setting.

6. An LED curing engine comprising a plurality of individually controllable LED modules operable according to a plurality of corresponding individual power level settings, wherein the individual power level settings are generated in response to user input corresponding to image characteristics in curing zones of a calibration image cured by corresponding individual controllable LED modules in the plurality of individually controllable LED modules to correct for variations in radiant energy output of the plurality of individually controllable LED modules and uniformly cure a printed image.

7. The LED curing engine of claim 6 wherein each LED module comprises a plurality of UV emitting LEDs.

8. The LED curing engine of claim 6 wherein the image characteristics comprise color saturation, surface finish, or transparency.

9. The LED curing engine of claim 6 wherein the individually controllable LED modules comprises tunable LEDs operable according the plurality of corresponding individual power level settings to generate variable intensity and spectral emissions.

10. A method of calibrating a plurality of individual UV curing modules comprising:

receiving an uncured calibration image;

initiating a curing operation comprising operating the plurality of individual UV curing modules according to a plurality of corresponding initial individual power level settings to apply radiant energy to the uncured calibration image to generate a cured calibration image;

receiving user input comprising information about an image characteristic of the cured calibration image;

analyzing the user input to generate adjustments to the plurality of corresponding initial individual power level settings; and applying the adjustments to the plurality of corresponding initial individual power level settings to generate a plurality of corresponding adjusted individual power level settings, the plurality of corresponding adjusted individual power level settings to correct for variations in radiant energy output of the plurality of individual UV curing modules to uniformly cure a printed image.

11. The method of claim 10, further comprising:

receiving a secondary uncured calibration image;

operating the plurality of individual UV curing modules according to the plurality of corresponding adjusted individual power level settings to apply radiant energy to the uncured calibration image to generate a secondary cured calibration image;

receiving additional user input comprising information about an image characteristic of the secondary cured calibration image;

analyzing the additional user input to generate secondary adjustments to the plurality of corresponding adjusted individual power level settings; and applying the secondary adjustments to the plurality of corresponding adjusted individual power level settings.

12. The method of claim 10, wherein initiating the curing operation further comprises operating the plurality of individual UV curing modules to generate a plurality of curing zones based on the plurality of corresponding initial individual power level settings.

13. The method of claim 12, wherein the curing zones correspond to image zones printed in the calibration image.

14. The apparatus of claim 13, wherein each of the image zones indicate a particular power level setting used to cure the curing zones that corresponds to the image zone.

* * * * *